US005752605A

United States Patent [19]

Cooper

[11] Patent Number: 5,752,605

[45] Date of Patent: May 19, 1998

[54] TRAY AND SLEEVE CARTON WITH DOUBLE FALSE WALLS

[75] Inventor: Leonard Cooper, West Monroe, La.

[73] Assignee: Riverwood International Corporation, Atlanta, Ga.

[21] Appl. No.: 641,937

[22] Filed: May 2, 1996

[51] Int. Cl.[6] ..... B65D 85/30

[52] U.S. Cl. ..... 206/725; 206/485; 206/589; 206/722

[58] Field of Search ..... 206/725, 723, 206/722, 485, 718, 586, 521, 587, 589, 592

[56] References Cited

U.S. PATENT DOCUMENTS

| | | | |
|---|---|---|---|
| 2,426,899 | 9/1947 | Pantalone | 206/485 X |
| 2,620,962 | 12/1952 | Powell | 206/485 |
| 2,706,590 | 4/1955 | Bergstein | 206/521 X |
| 5,372,259 | 12/1994 | Suzuki et al. | 206/586 |

FOREIGN PATENT DOCUMENTS

| | | | |
|---|---|---|---|
| 497623 | 9/1950 | Belgium | 206/485 |
| 999898 | 10/1951 | France | 206/485 |
| 431983 | 3/1948 | Italy | 206/485 |
| 273276 | 5/1951 | Switzerland | 206/485 |

*Primary Examiner*—Bryon P. Gehman

[57] ABSTRACT

A tray and sleeve carton adapted to protect delicate packaged articles, such as computer chips. The tray includes spaced integral tubular supports which contain recesses for receiving the end portions of packaged articles. Each recess has a bottom support shelf spaced from the bottom panel and a back wall spaced from the side panels, thus creating false walls which support and isolate the article from the outer structure of the carton.

5 Claims, 3 Drawing Sheets

TRAY AND SLEEVE CARTON WITH DOUBLE FALSE WALLS

FIELD OF THE INVENTION

This invention relates to a carton of the type comprised of an outer sleeve and an inner tray. More particularly, it relates to a carton of this type in which the tray includes article-receiving cells.

BACKGROUND OF THE INVENTION

When packaging delicate articles care must be taken to protect them against impact forces. In addition, certain types of articles, such as computer chips, can be adversely affected by dust commonly found in paperboard cartons.

One type of carton designed to package small items is comprised of a tray in which the articles are held and a sleeve in which the tray fits. Such cartons are strong and rigid and provide adequate protection for many types of products. A typical tray and sleeve carton, however, does not isolate the contents to the degree required by the shipment of computer chips, nor does it adequately protect against dusting.

A primary object of the invention, therefore, is to provide an improved tray and sleeve carton which is designed to fully protect computer chips or other delicate articles against impact forces while at the same time minimizing the tendency of the carton to dust.

BRIEF SUMMARY OF THE INVENTION

In accordance with the invention the tray that fits within the sleeve of a tray and sleeve carton includes opposed side panels, opposed end panels, a bottom panel and spaced article supports adjacent the side panels. Each article support is comprised of a top panel extending inwardly from the adjacent side panel and a support wall spaced from the side panel and extending downwardly from the top panel. The top panel and support wall include adjoining recesses for receiving an end portion of an article packaged in the carton. Opposite recesses in the article supports form a cell or receptacle, with the central portion of the article spanning the space between supports.

In a preferred arrangement the support wall of each article support is foldably connected to the associated top panel and the recess in the support wall extends down to an outwardly extending shelf which is foldably connected to the support wall. A back wall which is foldably connected to the top panel and to the support shelf of the article support is spaced from the adjacent side panel. In this manner the end portions of an article can rest on the support shelves and substantially abut the back walls. Because the support shelves are spaced from the bottom panel and the back walls are spaced from the side panels they function as false walls, serving to cushion and isolate the packaged articles from impact forces. Also, the arrangement reduces the amount of dust in the package. Additional structural support may be provided by support feet extending from the support walls and adhered to the bottom panel.

The carton is not only structurally sound and highly protective of the packaged articles, but is economical to produce and easy to fabricate. The above and other features and aspects of the invention will be readily ascertained from the detailed description of the preferred embodiment described below.

DETAILED DESCRIPTION OF THE PREFERRED EMBODIMENT

Figure 1:
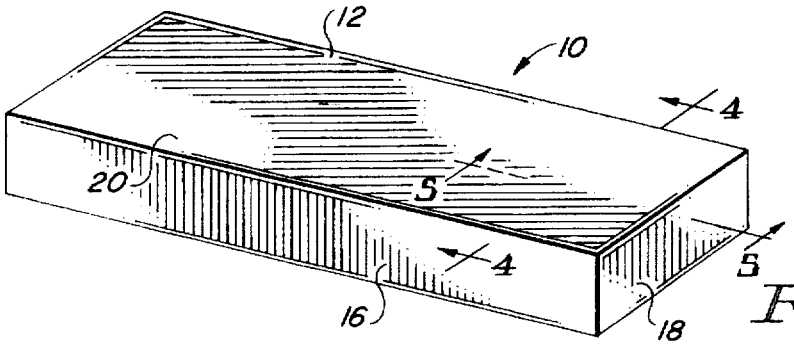
FIG. 1 is a pictorial view of a tray and sleeve carton incorporating the invention.
Figure 2:
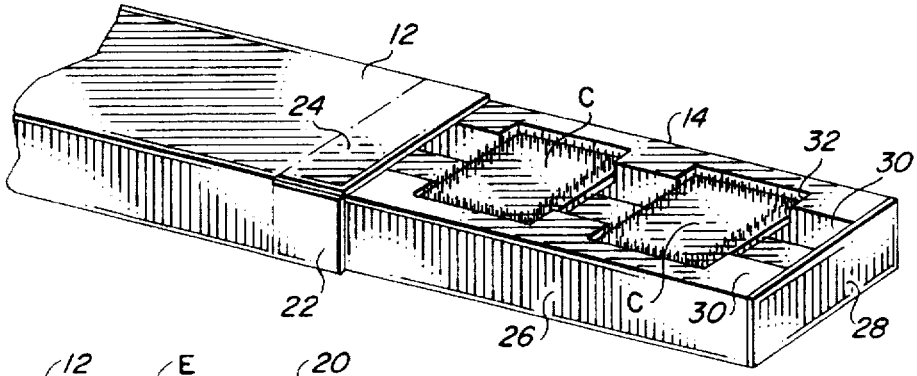
FIG. 2 is a partial pictorial view of the carton showing the carton after the sleeve has been opened and the tray partially removed.

Referring to FIGS. 1 and 2, a carton 10 embodying the invention is comprised of a sleeve 12 containing a tray 14 which can be slidably removed from the sleeve. The sleeve is rectilinear in shape and consists of opposed side panels 16, opposed end panels 18 and opposed top and bottom panels. The top panel 20 is visible in these views but the bottom panel is not. As shown by the open end panel of the sleeve in FIG. 2, the end panels 18 are formed from dust flaps 22 and end flaps 24. The tray 14 is also basically of rectilinear shape including opposed side panels 26 and opposed end panels 28. Extending along the length of the tray are spaced tubular supports 30 which include oppositely located recesses 32. Each pair of opposite recesses creates a cell or receptacle for computer chip C.

Figure 3:
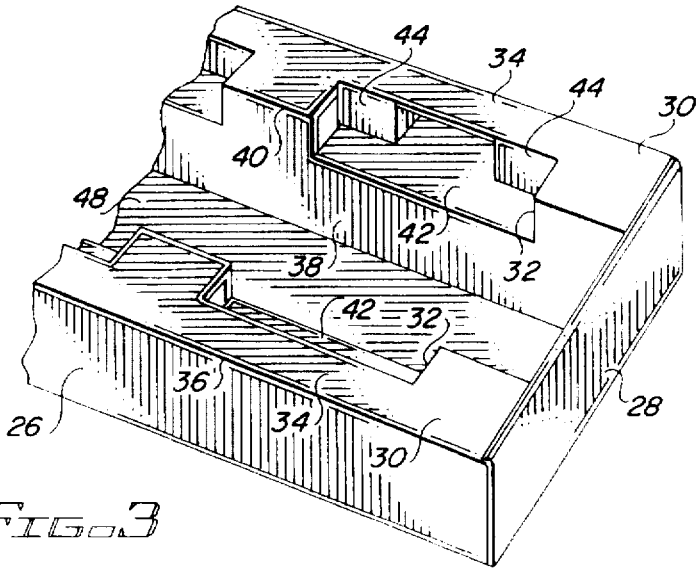
FIG. 3 is an enlarged partial pictorial view of an empty tray.

The construction of the tubular supports 30 is shown in greater detail in FIG. 3. Each tubular support includes a top panel 34 connected to the adjacent side panel 26 by fold line 36 and a vertical support wall 38 connected to the top panel by fold line 40. Both the top panel 34 and the support wall 38 are cut away to form a recess 32, which includes a shelf 42 extending outwardly from the wall 38 and short vertical back walls 44 extending downwardly from the top panel 34. The back walls 44 are foldably connected to the shelf 42, leaving a central portion of the shelf extending between the back walls to the associated side panel 26.

Figure 4:
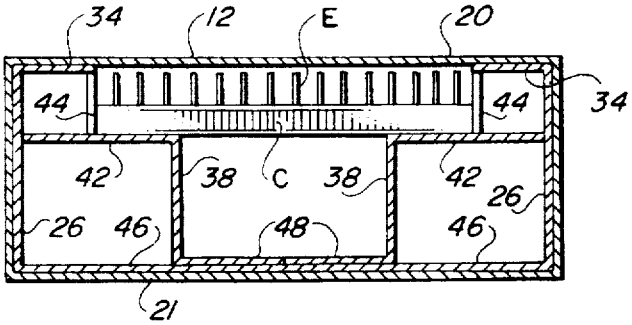
FIG. 4 is a transverse sectional view taken on line 4—4 of FIG. 1.
Figure 5:
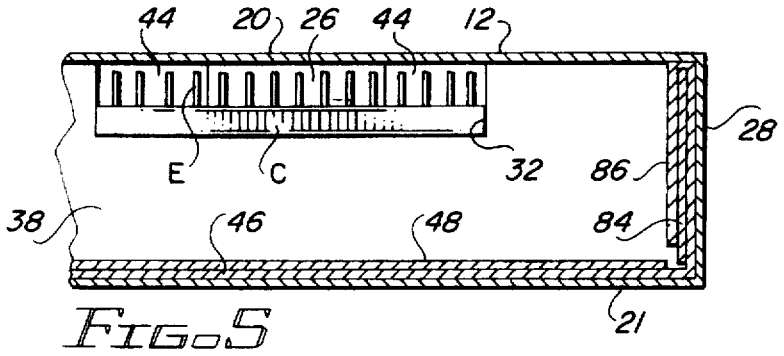
FIG. 5 is a longitudinal sectional view taken on line 5—5 of FIG. 1.

As shown in FIGS. 4 and 5, the tray includes bottom panel 46, which is foldably connected to the side panels 26. Reinforcing the central portion of the bottom panel are feet 48, which are foldably connected to the vertical walls 38 and extend inwardly toward each other. One of the feet 48 can also be seen in FIG. 3.

As also shown in FIGS. 4 and 5, the shelves 42 of a pair of opposite recesses support end portions of a computer chip C which spans the gap between opposite vertical support walls 38. The distance between the short back walls 44 of a pair of opposite recesses is substantially the same as the width of the chip, and the length of the shelves 42 is substantially the same as the length of the chip, both dimensions being large enough to allow the chip to be inserted into the receptacle formed by the recesses but small enough to prevent movement of the chip during shipment. This arrangement results in a double false wall construction. The back walls 44 against which the computer chip abuts are spaced from the side panels 26, thus comprising false vertical walls which isolate the chip from the side panels.

Similarly, the shelves 42 on which the computer chip rests are spaced from the bottom panel and comprise false horizontal walls, isolating the chip from the bottom panel. The computer chip is thereby insulated against impact forces directed to the side and bottom panels of the tray, and is further protected by the sleeve in which the tray fits. It can be seen that the shelves are spaced from the top panels 34 of the tray a distance which allows the tray to slide into and out of the sleeve 12 without the connectors E of the computer chip contacting the sleeve.

Figure 6:
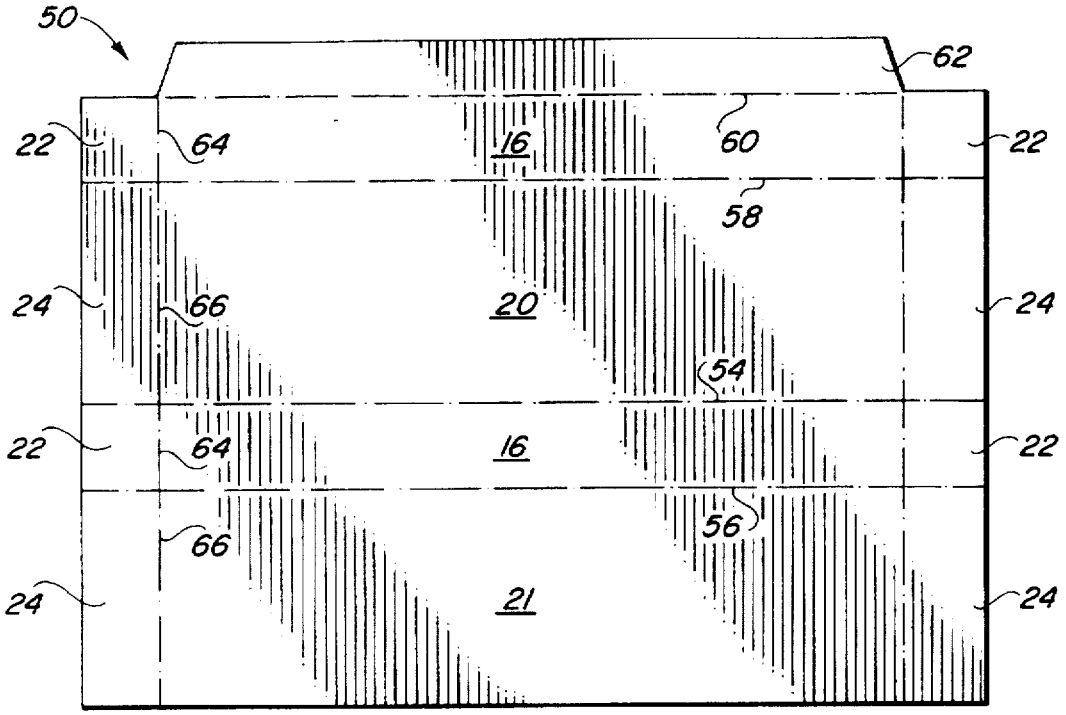
FIG. 6 is a plan view of a blank for forming the carton sleeve.

A blank 50 for forming the sleeve 12 is shown in FIG. 6 to be of conventional design, including top and bottom panel sections 20 and 21 connected by fold lines 54 and 56, respectively, to one of the side panel sections 16. The top panel section 20 is also connected by fold line 58 to the other side panel section 16, which in turn is connected by fold line 60 to glue flap 62. Dust flaps 22 are connected to the side panel sections by fold lines 64, while end flaps 24 are connected to the top and bottom panel sections by fold lines 66. The sleeve is formed from the blank in conventional manner well known in the art.

Figure 8:
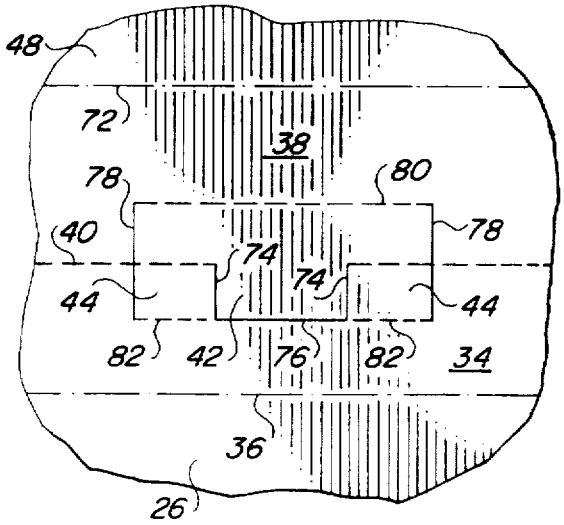
FIG. 8 is an enlarged partial plan view of the area enclosed by the circle 8 of FIG. 7.
Figure 7:
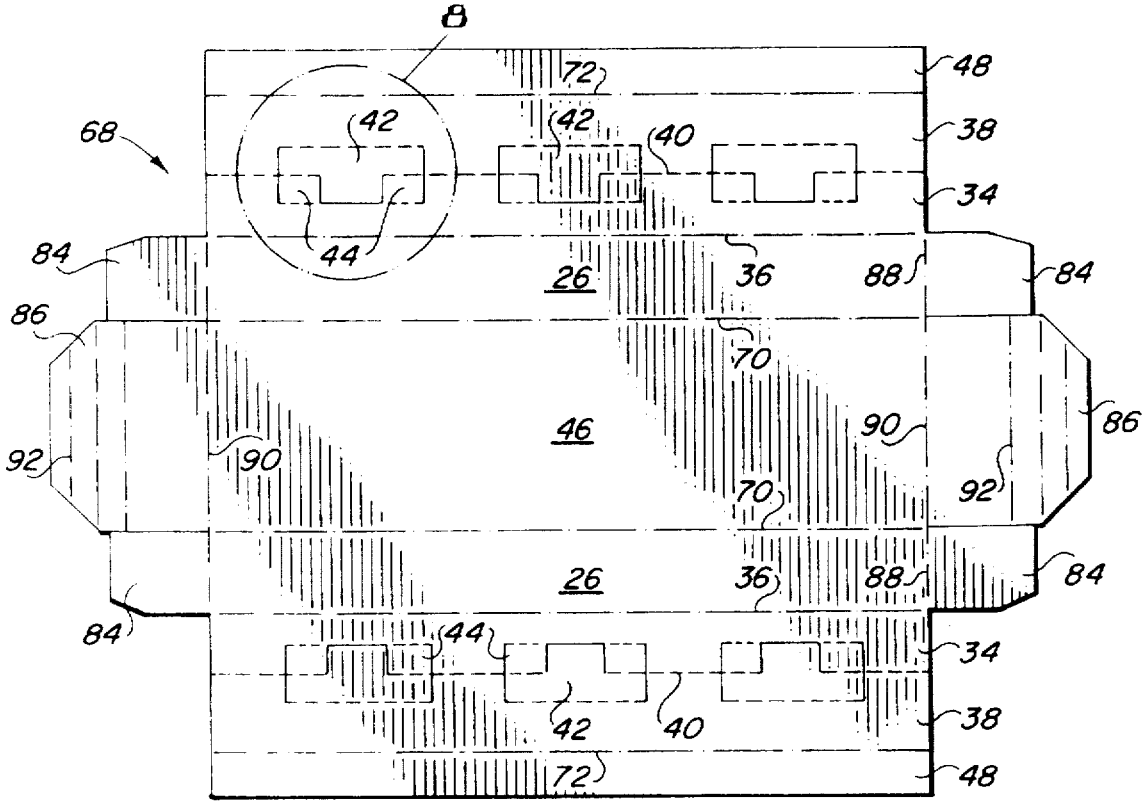
FIG. 7 is a plan view of a blank for forming the tray of the carton.

Referring to FIG. 7, a blank 68 for forming the tray is comprised of a centrally located bottom panel section 46 connected by fold lines 70 to side panel sections 26. Fold lines 36 connect the side panel sections 26 to top panel sections 34, and interrupted fold lines 40 connect the top panel sections 34 to support wall sections 38. The support wall sections 38 are connected to bottom panel foot flaps 48 by fold lines 72. As best shown in FIG. 8, at each location of the structure which forms an end of a receptacle the fold line 40 is interrupted by a pair of spaced transverse slits 74. The slits 74 connect the spaced ends of the fold line 40 to the ends of slit 76 located in the top panel section 34. Slits 78, which are parallel to and outwardly spaced from the slits 74, extend from the top panel section 34 into the support wall section 38. The ends of the slits 78 in the support wall section 38 are connected by fold line 80, while the ends of the slits 78 in the top panel section 34 are connected by fold lines 82 to the ends of slit 76. The fold lines 82, which are continuations of the slit 76, are parallel to the fold lines 40 and 80. The area bounded by the slits 76, 74 and 78 and the fold lines 40 and 80 form a receptacle shelf section 42, and the areas bounded by the slits 74 and 78 and the fold lines 40 and 82 form receptacle back wall sections 44.

Referring back to FIG. 7, each end of the blank 68 includes two dust flaps 84 and an end flap 86 for forming an end panel 28 of a tray. The dust flaps 84 are connected by fold lines 88 to the side panel sections 26 and the end flap 86 is connected by fold line 90 to the bottom panel section 46. In addition, spaced transverse fold lines 92 are provided in the end flap 86 to facilitate fabrication.

Figure 9:
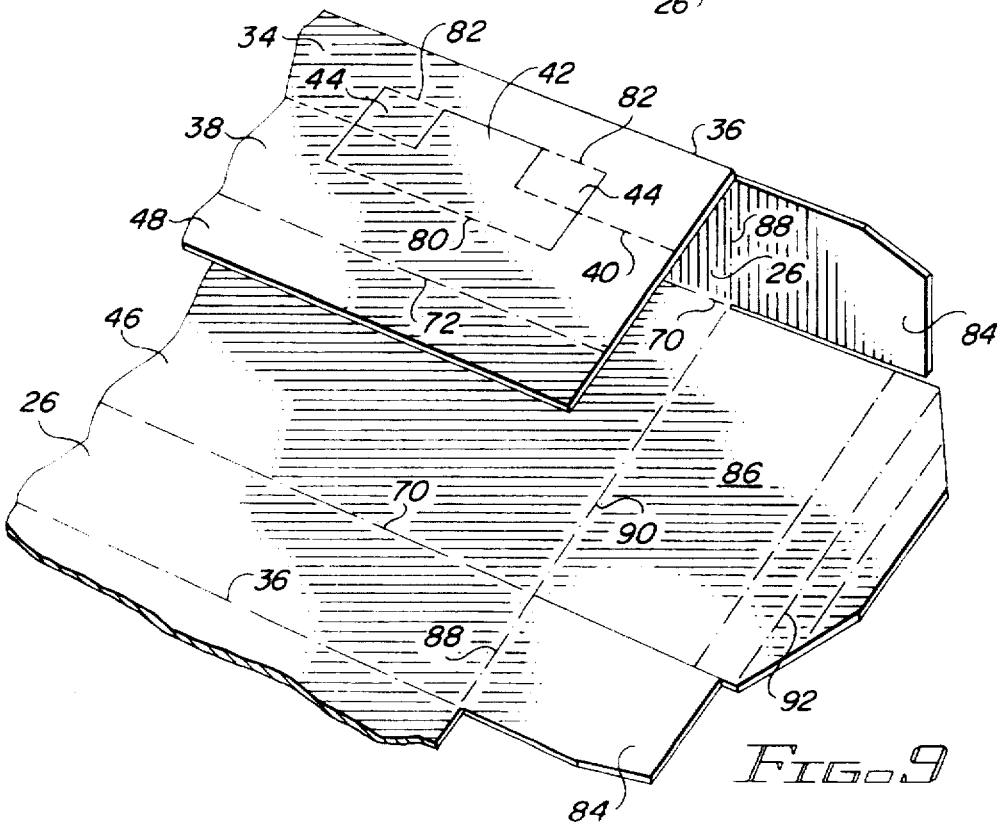
FIG. 9 is an enlarged partial pictorial view of a tray blank at an intermediate stage of fabrication.

To form a tray from the blank 68 the side panel sections 26 are pivoted up about fold lines 70, and the flaps made up of the unfolded sections 34, 38 and 48 are then folded inwardly about the fold lines 36. One of the sides of a blank in the process of being fabricated into a tray is illustrated at this stage in FIG. 9. A tubular support is formed by bending the foot flap 48 up about the fold line 72 and the vertical wall section 38 down about the fold line 40. At the same time, the shelf section 42 is pivoted down about the fold line 80. The pivoting of the shelf section need only be started in this direction, as the relative folding of the support wall section 38 and the top panel section 34 causes the shelf section to automatically fold into the final position shown in FIG. 3. The feet 48 are glued to the bottom panel section 46 to hold the tubular supports in place.

The end panels of the tray are formed in the usual manner, by first folding in the dust flaps 84, then folding the end flaps in place between the dust flaps and the tubular supports. This operation is facilitated by the transverse fold lines 92 in the end flaps which allow the end flaps to flex more easily as they are folded into place. The final end panel arrangement is more clearly illustrated in FIG. 5. If the tray is intended to be set up in a packaging machine the end flaps would be shortened and simply glued to the dust flaps instead of being folded into place. In such a design there would be no need for fold lines in the end flaps.

It can now be appreciated that the invention permits delicate products, such as computer chips, to be packaged in a safe substantially shock-proof manner by isolating the products from the outer carton panels. Not only is the tray in which the chips are contained protected by the carton sleeve, but the false walls of the receptacles holding the chips separate the chips from the side and bottom panels of the tray. The tray and sleeve arrangement protects against the entry of dust, and the receptacle structure which prevents the chips from movement within the carton prevents the creation of paperboard dust which would otherwise be caused by relative sliding movement between the chips and the carton.

The carton is simple and economical to manufacture and fabricate, and is ideally suited to the packaging of computer chips. Although the carton has been illustrated as being designed to package three computer chips, it will be understood that it may be modified to package other types of articles and fewer or greater numbers of articles. It should further be understood that the invention is not limited to all the specific details described in connection with the preferred embodiment, except as they may be within the scope of the appended claims, and that changes to certain features of the preferred embodiment which do not alter the overall basic function and concept of the invention are contemplated.

What is claimed is:

1. A carton, comprising;

a sleeve;

a tray within the sleeve;

the tray including opposed side panels, opposed end panels and a bottom panel;

a separate article support adjacent each side panel, the article supports being spaced from each other;

each article support including a top panel extending inwardly from the adjacent side panel and a support wall foldably connected to the top panel, the support wall being spaced from the adjacent side panel and extending downwardly from the top panel;

each article support further including a support shelf foldably connected to the support wall of the article support and extending outwardly toward the adjacent side panel;

the top panel and support wall of each article support including adjoining recesses for receiving an end portion of an article, the recesses in the article supports being located opposite each other so that opposite ends of an article can be received in opposite recesses, the recess in each article support extending down to the support shelf; and each article support including a back wall foldably connected to the top panel and to the support shelf of the article support, the back wall being spaced from the adjacent side panel and being comprised of spaced segments, the support shelf having a portion extending between the spaced segments toward the adjacent side panel.

2. A carton as defined in claim 1, wherein each support wall is foldably connected to a support foot, the support foot of each support wall extending toward each other and being adhered to the bottom panel.

3. A blank for forming a tray for use in a tray and sleeve carton, comprising:

a bottom panel section;

side panel sections connected by fold lines to opposite sides of the bottom panel section;

a top panel section connected by a fold line to each side panel section;

a support wall section connected by a fold line to each top panel section;

a support shelf section connected by a fold line to each support wall section, each support shelf section extending at least to an associated top panel section;

the support shelf sections being oppositely located so that when folded in a tray formed from the blank, oppositely located recesses are created in such a tray for receiving end portions of an article;

a back wall section connected by a fold line to the top panel section, each back wall section extending at least to an associated support wall section;

each support shelf section being connected to an associated back wall section by a fold line which is a continuation of the fold line connecting an associated support wall section to a top panel section; and each back wall section being comprised of spaced segments, each support shelf section having a portion extending between the spaced segments.

4. A blank as defined in claim 3, wherein each support wall section is foldably connected to a support foot flap adapted to be in face-to-face contact with the bottom panel section in a tray formed from the blank.

5. A package, comprising:

a sleeve;

a tray within the sleeve;

the tray including opposed side panels, opposed end panels and a bottom panel;

a separate article support adjacent each side panel, the article supports being spaced from each other;

each article support including a top panel extending inwardly from the adjacent side panel and a support wall spaced from the adjacent side panel and extending downwardly from the top panel;

the top panel and support wall of each article support including adjoining recesses;

the support wall of each article support being foldably connected to the top panel associated therewith, each article support including a support shelf foldably connected to the support wall of the article support and extending outwardly toward the adjacent side panel, the recess in each article support extending down to the support shelf;

each article support including a back wall foldably connected to the top panel and to the support shelf of the article support, the back wall being spaced from the adjacent side panel;

the back wall of each article support being comprised of spaced segments, the support shelf having a portion extending between the spaced segments toward the adjacent side panel; and a computer chip having opposite end portions in the recesses adjacent the back wall and resting on the support shelf, the computer chip including upwardly extending connectors which are spaced from the sleeve.

* * * * *